United States Patent [19]

Goi

[11] Patent Number: 4,484,735

[45] Date of Patent: Nov. 27, 1984

[54] NOTE SEPARATING AND DELIVERING APPARATUS FOR USE IN NOTE HANDLING MACHINE

[75] Inventor: Kowichi Goi, Tokyo, Japan

[73] Assignee: Laurel Bank Machine Co., Ltd., Tokyo, Japan

[21] Appl. No.: 375,312

[22] Filed: May 5, 1982

[30] Foreign Application Priority Data

May 6, 1981 [JP] Japan ..... 56-67928

[51] Int. Cl.[3] ..... B65H 3/56; B65H 1/02; B65H 3/08

[52] U.S. Cl. ..... 271/12; 271/11; 271/106; 271/107

[58] Field of Search ..... 271/5, 84, 10, 11-13, 271/15, 99-103, 106-108, 132

[56] References Cited

U.S. PATENT DOCUMENTS 3,077,983 2/1963 Middleditch ..... 271/100
3,586,313 6/1971 Ebeling ..... 271/10

FOREIGN PATENT DOCUMENTS 0040182 3/1980 Japan ..... 271/107

*Primary Examiner*—Bruce H. Stoner, Jr.
*Assistant Examiner*—James E. Barlow
*Attorney, Agent, or Firm*—Fleit, Jacobson, Cohn & Price

[57] ABSTRACT

A note separating and delivering apparatus for use in a note handling machine includes a delivery mechanism. The delivery mechanism comprises grabbing rollers disposed at the middle portion thereof for grabbing the note from the suction heads. The delivery mechanism further comprises feeding members disposed at the opposite sides of the grabbing rollers for compensating for the delay of the notes at the side portions thereof.

4 Claims, 5 Drawing Figures

NOTE SEPARATING AND DELIVERING APPARATUS FOR USE IN NOTE HANDLING MACHINE

BACKGROUND OF THE INVENTION

The present invention relates to a delivery mechanism of a note separating and delivering apparatus for use in a note handling machine. This note separating and delivering apparatus takes off notes one at a time by suction heads, grabs the notes by grabbing rollers and delivers the notes to a predetermined section.

An example of the conventional note separating and delivering apparatus will now be described. A plurality of grabbing rollers are provided, and these rollers are secured to the grabbing roller shaft with such a phase deviation that the rollers grabbing both the sides of a note performs the grabbing operation slightly later than the roller grabbing the middle of the note. The reason is as follows. When a note is taken off by the sucking action of suction heads, the middle portion of the note is supported by the suction heads, and therefore, the middle portion of the note can be grabbed relatively assuredly. However, since both the side portions of the note are kept in the free state at the sucking step, both the side portions of the note are grabbed slightly later than the middle portion of the note. Accordingly, the grabbing operation is performed with a phase deviation corresponding to the delay of grabbing of both the side portions of the note, whereby occurrence of an undesirable phenomenon of bending of both the side portions of the note is prevented.

However, this undesirable bending phenomenon is liable to occur when the quantity of the phase separation is too large or too small, and it is very difficult to adjust the quantity of the phase deviation appropriately. Furthermore, even if such adjustment is made, since the nerve of a new note is different from that of a used note, because of the fixed quantity of the phase deviation, it is impossible to prevent occurrence of the bending phenomenon completely.

SUMMARY OF THE INVENTION

The present invention has been completed under such background, and it is a primary object of the present invention to provide a delivery mechanism of a note separating and delivering apparatus in which feeding members which are rotated at a speed an integral number of times the rotation number of a grabbing roller grabbing the middle portion of a note are arranged at a position corresponding to both the side portions of the note, whereby occurrence of a phenomenon of bending of both side portions of the note is prevented.

In accordance with the present invention, there is provided a note separating and delivering apparatus for use in a note handling machine wherein notes are taken off, one at a time, from a note holder plate, and delivered to a predetermined section, which includes a delivery mechanism, the delivery mechanism comprising, at least one movable suction head for taking off the notes, one at a time from the note holder plate, at least one grabbing roller disposed downstream of the suction heads for grabbing the note at the middle portion thereof from the suction heads and rotatable feeding members disposed at opposite sides of the grabbing roller for grabbing the note at the opposite sides thereof, the feeding members being adapted to be rotated in synchronism with the rotation of the grabbing roller approximately when the note has been grabbed by the grabbing roller.

DESCRIPTION OF THE DRAWINGS

The present invention will now be described in detail by reference to an embodiment illustrated in the accompanying drawings in which.

DESCRIPTION OF THE PREFERRED EMBODIMENT

One embodiment of the present invention will be now described in detail with reference to the accompanying drawings.

FIGS. 1 through 5 of the accompanying drawings show an embodiment in which the present invention is applied to a note separating and delivering apparatus of a note dispenser. The note separating and delivering apparatus comprises a note holding plate 1 for holding accumulated notes S, suction heads 2 for sucking and taking off the notes on the note holding plate 1 one at a time, and a delivery mechanism 3 for grabbing the notes S taken off by the suction heads 2 and delivering them to a predetermined section.

Figure 1:
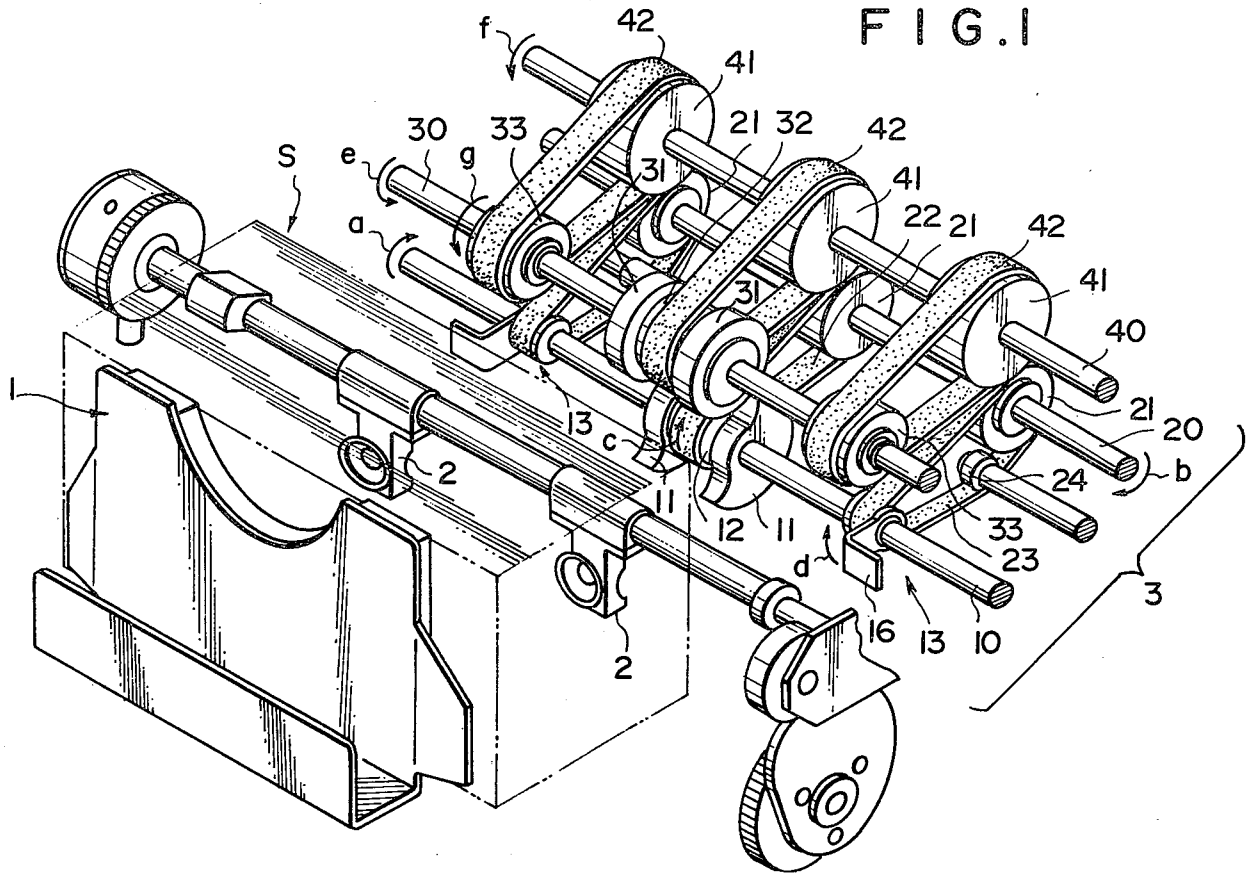
FIG. 1 is a perspective view showing a note separating and delivering apparatus for use in a note dispenser according to the present invention.
Figure 5:
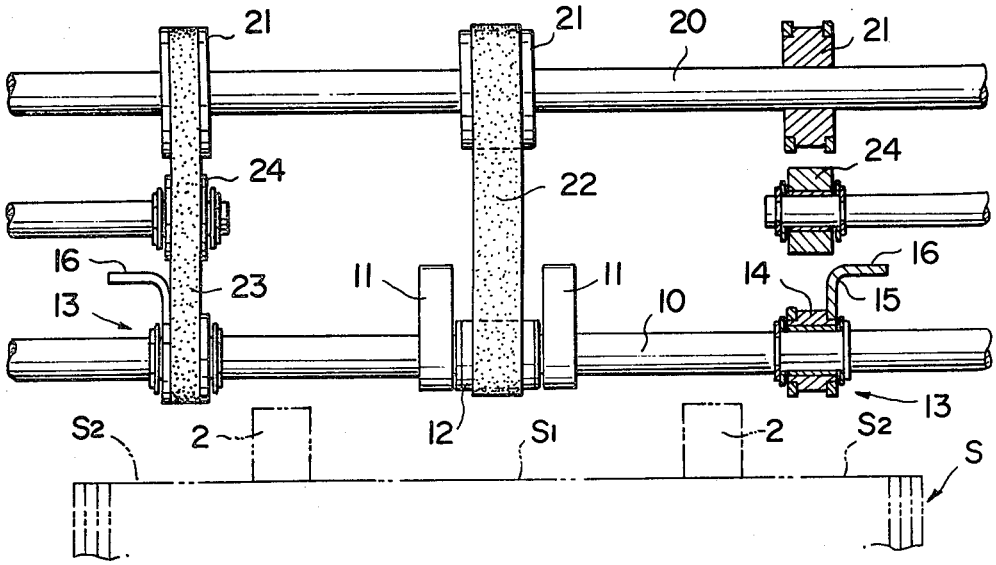
FIG. 5 is a plan view showing the main portion of the delivery mechanism.

In the delivery mechanism 3, a grabbing roller shaft 10 is rotated in the direction of arrow A in FIG. 1, and a pair of substantially meniscus-shaped grabbing rollers 11 for grabbing the middle portion S1 of the note are fixedly attached to the central portion of the grabbing roller shaft 10 and a pulley 12 is rotatably supported on the grabbing roller shaft 10 between the grabbing rollers 11. Feeding members 13 are rotatably supported on both the side portions of the grabbing roller shaft 10. As shown in FIG. 5, this feeding member 13 comprises a feeding pulley 14 and a feeding piece 15 integral with the feeding pulley 14. The feeding piece 15 is projected in the direction intersecting the axial line of the grabbing roller shaft 10 at a right angle. The contact face 16 of the feeding piece 15, which falls in contact with each side portion S2 of the note, is bent in the direction opposite to the position of the grabbing rollers 11.

Disposed along the grabbing roller shaft 10 is a lower delivery shaft 20 rotating in the direction of arrow b in FIG. 1. Delivery rollers 21 are fixedly attached to the middle portion and both the side portions of the lower delivery shaft 20. A delivery belt 22 for rotating the pulley 12 on the grabbing roller shaft 10 in the direction of arrow c in FIG. 1 is trained on the delivery roller 21 attached to the middle portion of the lower delivery shaft 20. Timing belts 23 for rotating the feeding members 13 rotatably supported on the grabbing roller shaft 10 in the direction indicated by arrow d in FIG. 1 are trained on the delivery rollers 21 attached to both the side portions of the lower delivery shaft 20. Tension rollers 24 are arranged between the lower delivery shaft 20 and the grabbing roller shaft 10 to produce a certain tension on the timing belts 23.

A bite-in roller shaft 30 rotating in the direction of arrow e in FIG. 1 is arranged above the grabbing roller shaft 10, and bite-in rollers 31 which are adapted to be engaged with the grabbing rollers 11 are fixedly attached to the middle portion of the bite-in roller shaft 30. A pulley 32 is rotatably supported on the bite-in roller shaft 30 between the bite-in rollers 31, and delivery rollers 33 are rotatably supported on the bite-in roller shaft 30 on both the side portions thereof.

An upper delivery shaft 40 rotating in the direction of arrow f in FIG. 1 is arranged along the bite-in roller shaft 30 and above the lower delivery shaft 20. Delivery rollers 41 are fixedly attached to the middle portion and both the side portions of the upper delivery shaft 40. Delivery belt 42 for rotating the pulley 32 supported on the bite-in roller shaft 30 and the delivery roller 33 in the direction of arrow g in FIG. 1 are trained on the delivery rollers 41.

A joint zone C (in which the note S is fed) is defined in nips between the delivery belt 22 trained on the delivery roller 21 of the lower delivery shaft 20, the timing belts 23 and the delivery belts 42 trained on the delivery rollers 41.

The shafts 10, 20, 30 and 40 are connected to one another through gears (not shown) differing in the tooth number and driven by a driving source (not shown) so that the rotation number of the pulley 12 and feeding member 13 rotatably supported on the grabbing roller shaft 10 is an integral number of times the rotation number of the grabbing roller shaft 10 and, therefore grabbing rollers 11 (for example, the pulley 12 and feeding member 13 makes two revolutions while the grabbing rollers 11 make one revolution).

Delivery of notes S by the delivery mechanism having the above-mentioned structure will now be described. A note S taken off (separated) in the direction of arrow h in FIG. 2 by the suction heads 2 is taken in between the grabbing rollers 11 and the bite-in rollers 31. At this step, both the side portions S2 of the note S are moved while having contact with the contact faces 16 of the feeding members 13 rotating at a speed two times the rotation number of the grabbing rollers 11 which grab the middle portion S1 of the note S. At the initial stage of the grabbing operation, the action of grabbing both the side portions of the note falls behind the action of grabbing the middle portion of the note held by two suction heads 2, and in the state where both the side portions of the note are taken in between the grabbing rollers 11 and bite-in rollers 31. However, this delay is cancelled due to a difference in rotational speed and both the side portions of the note are delivered synchronously with the middle portion of the note without bending of both the side portions S2 of the note.

The operation of the delivery mechanism according to the present invention will now be described in detail.

Figure 2:
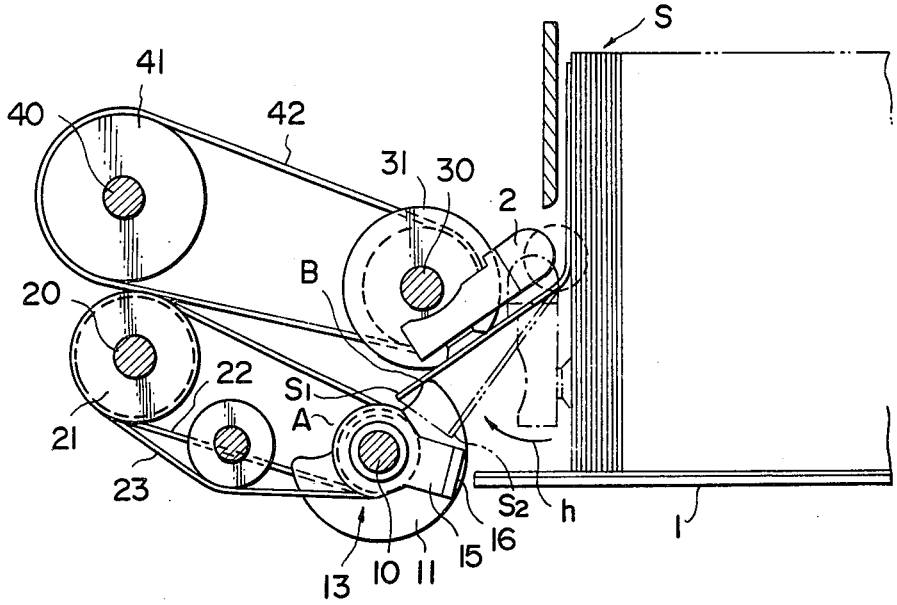
FIGS. 2 through 4 are side views showing the steps of grabbing notes by the delivery mechanism of the note separating and delivering apparatus.
Figure 3:
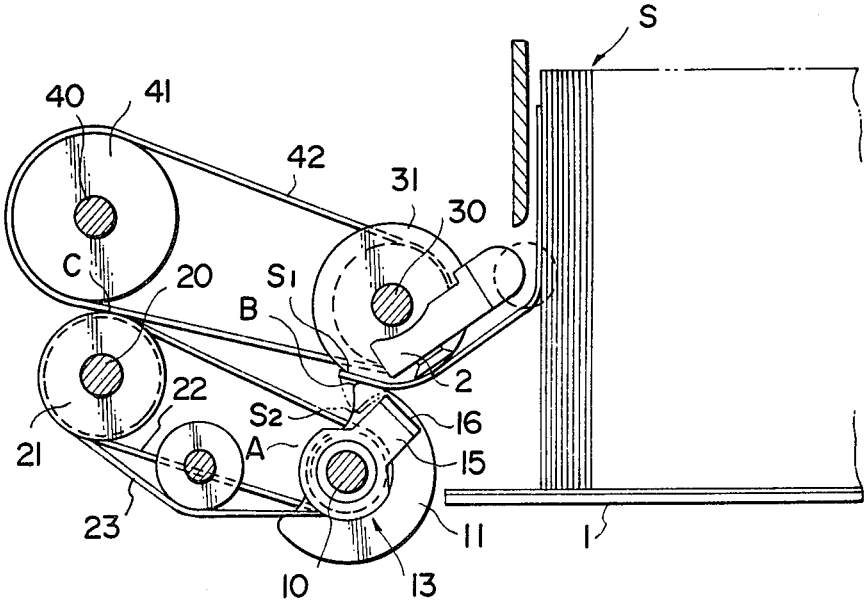

When the suction heads 2 attract the note S in the initial state indicated by a one-dot chain line in FIG. 2, and begin to rotate, the suction heads 2 are brought into the state indicated by a solid line in FIG. 2. In this state, the rotation speed of the suction heads 2 is adjusted to be about half of the rotation speed of the grabbing rollers 11. Therefore, after the leading end of the note S passes through a recess A of the grabbing roller 11, it falls in contact with the leading end portions B of the grabbing rollers 11. At this point, the middle portion S1 of the note is rotated synchronously with the suction heads 2, but both the side portions S2 of the note fall behind the middle portion S1 of the note as indicated by a two-dot chain line in FIG. 2. At this point, the feeding members 13 are located at the position where rotation of the feeding members 13 falls behind the rotation of the grabbing rollers 11, and at this position, the contact faces 16 of the feeding members 13 do not fall in contact with both the side portions S2 of the note as yet.

Then, the rotation of each feeding member 13 is advanced and the leading end portions B of the grabbing rollers 11 are going to further feed the middle portion S1 of the note in the clockwise direction in FIG. 2. The middle portion S1 of the note is nipped between the grabbing rollers 11 and the bite-in rollers 31 and are going to be fed in the delivery direction of the delivery belts 42. At this point, as described hereinbefore with respect to the conventional technique, the operation of grabbing both the side portions S2 of the note falls behind the operation of grabbing the middle portion S1 of the note. At the position indicated in FIG. 3, the rotation of the suction heads 2 are stopped, and the suction heads 2 stop the sucking action and set the note S free. Since the feeding members 13 rotate at a speed two times the rotation speed of the grabbing rollers 11, at the position shown in FIG. 3 the contact faces 16 fall in contact with the side portions S2 of the note.

Figure 4:
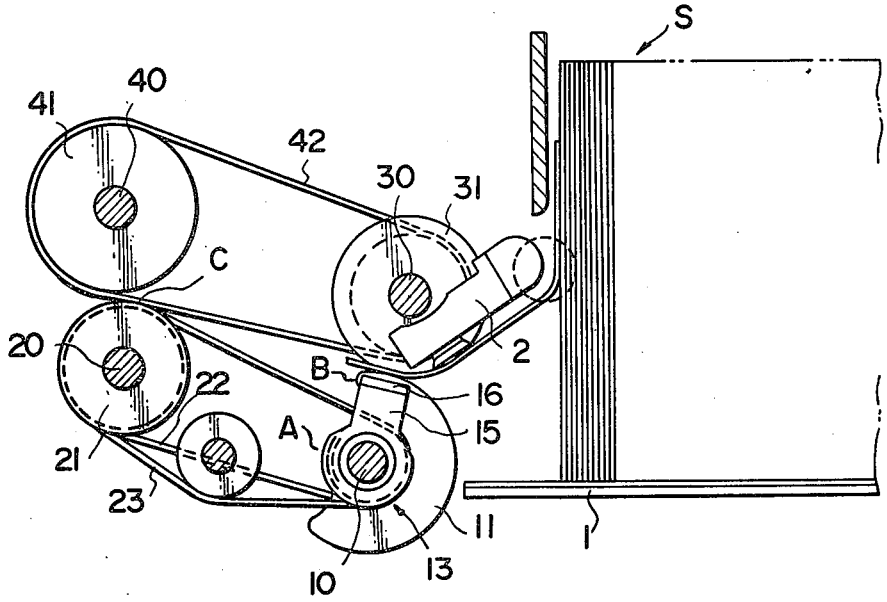

Then, as shown in FIG. 4, the grabbing rollers 11 and the feeding members 13 are further rotated and the feeding members 13 reach the leading end portions B of the grabbing rollers 11, and both the side portions S2 of the note are allowed to catch up with the middle portion S1 of the note by the contact faces 16 and the leading end portion of the note S is substantially straightened in parallel to the delivery direction. Thus, the note S is fed by the grabbing rollers 11 and the bite-in rollers 31 in the delivery direction of the delivery belts 22 and 42 and the timing belt 23, and the note S is delivered to a predetermined section through the joint zone C while the note S is maintained on the same plane.

Then, the suction heads 2 are returned to the initial position indicated by the one-dot chain line in FIG. 2 and the suction heads 2 stand by until they attract a subsequent note S.

Then, the foregoing operations are repeated in the same manner.

In the foregoing embodiment, by combining gears differing in the tooth number, the feeding members 13 are rotated at a speed, for example, 2 times the speed of the grabbing rollers 11. There may be adopted a modification in which the feed members 13 are rotated at a speed an integral number of times, for example, at least 3 times, the speed of the grabbing rollers, so far as the feeding members 13 are synchronized with the grabbing rollers 11 in the state shown in FIG. 4. Furthermore, the timing belts 23 may be connected to a different driving source to multiply the rotation speed of the feeding member over the speed of the grabbing rollers.

As will be apparent from the foregoing description, according to the present invention, the feeding members for grabbing both the side portions of a note are rotated at a speed an integral number of times the rotation speed of the grabbing rollers for grabbing the middle portion of the note, whereby both the side portions of the note are allowed to catch up with the middle portion of the note while the note is grabbed. By dint of this characteristic feature, there can be attained various excellent effects according to the present invention. For example, even if new notes and used notes are treated, occurrence of bending of both the side portions of notes can be prevented completely. Furthermore, the operation efficiency of the note separating and delivering apparatus can be increased.

What is claimed is:

1. A note separating and delivering apparatus for use in a note handling machine wherein notes are taken off, one at a time, from a note holder plate, and delivered to a dispensing section, said apparatus comprising:

a delivery mechanism including at least one movable suction head for moving the notes one at a time from the note holder plate, at least one grabbing roller and at least one bite-in roller cooperating therewith to form a nip positioned downstream from the at least one suction head for grabbing the note from the suction head at the middle portion of the note, and rotatable feeding members positioned on opposite sides of the at least one grabbing roller for feeding the note on opposite sides of the middle portion of the note, the feeding members being adapted for rotation faster than the at least one grabbing roller, and the feeding members being driven independently of the at least one grabbing roller wherein the feeding members guide the sides of the note so that the sides and the middle of the end of the note being fed are brought into the same plane as the note is grabbed and transported.

2. An apparatus as set forth in claim 1, wherein the feeding members are rotated at a speed that is an integral number of times the rotation speed of the at least one grabbing roller, the integral number being more than one.

3. An apparatus as set forth in claim 1, further comprising a grabbing roller shaft with the at least one grabbing roller being fixedly connected to the grabbing roller shaft and the feeding members being rotatably supported on the grabbing roller shaft.

4. An apparatus as set forth in claim 1, further comprising a delivery shaft wherein the feeding members are driven through timing belts by the delivery shaft.

* * * * *